United States Patent [19]

Maegawa et al.

[11] Patent Number: 5,058,516

[45] Date of Patent: Oct. 22, 1991

[54] APPARATUS FOR AUTOMATICALLY POSITIONING PANTYHOSE MATERIALS IN A PANTY PART SEWING MACHINE

[75] Inventors: Hiroji Maegawa, Kashihara; Tatsurou Omuta, Kitakatsuragi; Hiroshi Ogita; Takanori Imai, both of Yoshino, all of Japan

[73] Assignees: Takatori Corporation; Takatori Hitech Co., Ltd., both of Nara, Japan

[21] Appl. No.: 620,192

[22] Filed: Nov. 30, 1990

[30] Foreign Application Priority Data

Nov. 30, 1989 [JP] Japan ..... 1-312410

[51] Int. Cl.[5] ..... D05B 21/00

[52] U.S. Cl. ..... 112/121.12; 112/121.15; 223/112

[58] Field of Search ..... 112/121.12, 121.15, 112/121.11, 27, 304, 262.2; 223/112

[56] References Cited

U.S. PATENT DOCUMENTS 4,541,351 9/1985 Horita et al. ..... 112/262.2

4,784,070 11/1988 Thurner et al. ..... 112/121.15

4,957,051 9/1990 Maegawa et al. ..... 112/121.12

*Primary Examiner*—Peter Nerbun

*Attorney, Agent, or Firm*—Wenderoth, Lind & Ponack

[57] ABSTRACT

An apparatus for automatically positioning welt portions and garter lines of pantyhose materials by aligning upper and lower positions in relation to each other for carrying out a pantyhose panty part seaming process, in which when detection sensors detect materials roughly fitted to respective upper and lower template assemblies, plates for positioning garter lines cause a panty part to move backward to be inserted deeply onto the template assemblies and the garter lines of the upper and lower materials are positioned by aligning with each other through detection sensors for positioning garter lines, and successively, a plate for positioning welt portions causes the panty part to move backward, stretching the panty part to a prescribed length so that the welt portions of the upper and lower materials are aligned with each other, thus fully fitting the upper and lower materials to the template assemblies and, at the same time completing the positioning of the welt portions and garter lines by aligning upper and lower positions in relation to each other.

1 Claim, 12 Drawing Sheets

APPARATUS FOR AUTOMATICALLY POSITIONING PANTYHOSE MATERIALS IN A PANTY PART SEWING MACHINE

BACKGROUND OF THE INVENTION

The present invention relates to an apparatus for automatically positioning pantyhose materials in a panty part sewing machine, and more particularly, to an automatic positioning apparatus for carrying out the first preparatory step involved in pantyhose hip portion seaming operation, in which a welt portion and garter line of pantyhose materials respectively mounted on a pair of upper and lower templates of a template unit are positioned by aligning upper and lower positions in relation to each other.

PRIOR ART

Tubularly knit stocking material S as shown in FIG. 15 is used to carry out pantyhose seaming operation. A pair of materials $S_1$, $S_2$ of a panty part 1 are superposed on each other and slicing is applied to the superposed portion. Then the sliced part is seamed to form seam 2, thus obtaining pantyhose 3 as shown in FIG. 16.

Thus, for the purpose of forming a pair of hoses into panty hoses in aforesaid manner with use of a pair of pantyhose materials (hereinafter referred to as materials )$S_1$, $S_2$, an automatic pantyhose hip portion seaming machine disclosed, for example, in Japanese Patent 880791, has been widely used.

FIG. 14 schematically shows the aforementioned automatic pantyhose hip portion seaming machine, in which a plurality of freely rotatable template units 5 are provided at certain intervals on a horizontal carrier 4.

Each template unit 5 comprises right and left arms 8, 8 having a pair of right and left and a pair of upper and lower templates 6, 6 and 7, 7. Each pair of right and left templates held in parallel relation are movable through open-close motion of the arms 8, 8 in such a manner that they are opened along the circular track of the carrier 4 and brought back to their original positions. Each pair of upper and lower templates are movable for contact engagement with and disengagement from each other.

The template unit 5 is rotatable in the clockwise direction through the rotation of the carrier 4 and are positioned in order in operating stations I to VI provided on the circular track of the carrier 4.

The first operating station I is where the materials are mounted on the template unit 5. The materials are roughly mounted on each upper template 6, 6 and lower template 7, 7.

Fitting the materials may be carried out manually and it may also be carried out automatically using automatic fitting apparatus proposed in Japanese Patent Application Sho 63-88542 or in Japanese Patent Application No. Hei 1-99178.

In the course of the template unit 5 having the materials $S_1$, $S_2$ mounted thereon from the second operating station II to the third operating station III, the material S roughly mounted on each pair of the upper and lower templates 6, 6 and 7, 7 is drawn backward by a positioning apparatus 9 so as to position welt portions 11 of the materials $S_1$ and $S_2$ at prescribed positions. In the third operating station III, inner portions of the panty part 1 are cut by a cutter means 10 to form a panty part. Then in the fourth operating station IV, the right and left templates are opened on the circular track so that the cut edges of the inner portions of the materials $S_1$, $S_2$ superposed each other and nipped together are exposed outside.

As the template unit 5 travels to operating station V, the so exposed cut edges of the inner portions of the materials $S_1$, $S_2$ are sewn together by a sewing machine 12 into a seam.

In the course of the template unit 5 further travelling to the sixth station VI, the materials thus sewn are removed from the template unit 5 and the right and left template assemblies of the template unit 5 are caused to return to their original parallel state to be transferred again to the first operating station I.

In the meantime, when sewing pantyhose with use of a pair of the materials $S_1$ and $S_2$, unless upper and lower ends of the welt portions 11 and the garter lines 13 of both materials $S_1$, $S_2$ are positioned in alignment with each other, defectives having irregularities in panty seams in the panty portion 1, as shown in FIG. 17, will be produced.

Therefore, in order to position the upper and lower materials $S_1$, $S_2$ roughly fitted to the template unit 5 in the first operating station I, the positioning apparatus 9 provided between the second operating station II and the third operating station III is required to have a function of positioning upper and lower ends of the welt portion 11 and the garter lines 13 of the upper and lower materials $S_1$, $S_2$ in alignment with each other.

A prior automatic positioning apparatus as is known in Japanese Patent Application Sho 61-55396, has such positioning structure as follows. Namely, detection means for optically and independently detecting each end of materials mounted on a pair of right and left and upper and lower templates are provided in a rotatable unit which travels integrally and synchronously with the template unit 5 travelling from the second operating station II to the third operating station III, said detection means detecting either one of the material ends mounted on the upper or lower templates, so that the other material end is caused to be transferred by a positioning plate according to a standard of the detected position on the template assemblies to be superposed with the aforesaid end of the material, thus completing the positioning.

However, in the aforementioned positioning apparatus, only the hems of welt portions of the upper and lower materials are detected by the detecting means and positioned, which tends to cause inaccurate positioning of the garter lines. Thus a problem rises that irregularities of the garter lines are easily caused in seaming the panty part.

Further, while full and complete insertion of the materials into the template assemblies needs to be carried out manually, the material ends are transferred in the state of nipped together by a pair of positioning plates positioned at each side of the template assemblies, which results in irregular positioning at the garter lines due to change in expansion and contraction in the panty part of the upper and lower materials since some tensile strength is applied to the flexible materials.

SUMMARY OF THE INVENTION

Accordingly, for the purpose of solving the above mentioned problems, an object of this invention is to provide an apparatus for automatically positioning pantyhose materials, in which a pair of materials having been roughly fitted to upper and lower template assemblies are fully inserted thereto and at the same time welt portions and garter lines of the fully inserted materials can be aligned with each other, thus making it possible to sew products free of irregularities at the seamed portions in a panty part.

With the purpose of overcoming the aforesaid problems, this invention includes a unit base which is located behind the positions for fitting pantyhose materials by template unit above the template unit and synchronously travels over a certain range with the template assemblies at equal speed, comprising positioning plates of upper and lower template assemblies for welt portions, each of which freely moves toward and away from each side of the upper and lower template assemblies along the length of the template assemblies to make the welt portions held from both sides move deeply to the template assemblies; positioning plates of upper and lower template assembles for garter lines, each of which freely moves toward and away from each side of the upper and lower template assemblies along the length of the template assemblies to make a panty part held from both sides move deeply to the template assemblies prior to the move of the positioning plates for welt portions; detection sensors for detecting pantyhose materials roughly fitted to each upper and lower template assemblies and actuating the positioning plates for garter lines and welt portions in a delayed manner; sensors for positioning garter lines, which detect garter lines of the materials having been fitted by the plates for positioning garter lines at locations above and below each pantyhose material fitted to the upper and lower template assemblies to make the plates for positioning garter lines stop; and sensors for positioning welt portions, which detect welt portions having bee moved by the plates for positioning welt portions at front positions to make the plates for positioning welt portions stop.

When the sensors for detecting materials detect the materials each roughly fitted to the upper and lower template assemblies, the plate for positioning garter lines hold panty parts of the upper and lower materials from both sides to insert the panty part deeply into the template assemblies, until the sensors for positioning garter lines detect the garter lines. With the stop of the plates for positioning garter lines, the garter lines of the upper and lower materials are thus aligned.

Then when the sensors for positioning welt portions move forward to prescribed positions, the plates for positioning welt portions hold the welt portions from both sides and move forward to make the welt portions move to the back of the template assemblies, stretching the slack of the panty parts. When the welt portions are detected by the sensors for positioning welt portions, the positioning plates are stopped, thus completing the alignment of welt portions of the upper and lower materials in the condition that the panty parts are stretched to a prescribed length.

Thus while the panty parts of the upper and lower materials are fully fitted to each template assembly, both welt portions and garter lines are positioned by aligning with each other.

DETAILED DESCRIPTION OF THE PREFERRED EMBODIMENT

The preferred embodiment of the present invention will now be explained with reference to the accompanying drawings. As described above with reference to FIG. 14, the operation of positioning materials needs to be carried out in the course of travelling the template unit 5 from the second operating station II to the third operating station III so that the materials $S_1$, $S_2$ are roughly fitted to the upper and lower template assemblies of the template unit 5 in the first operating station I and the slicing is applied to the panty portion in the third operating station III.

Figure 14:
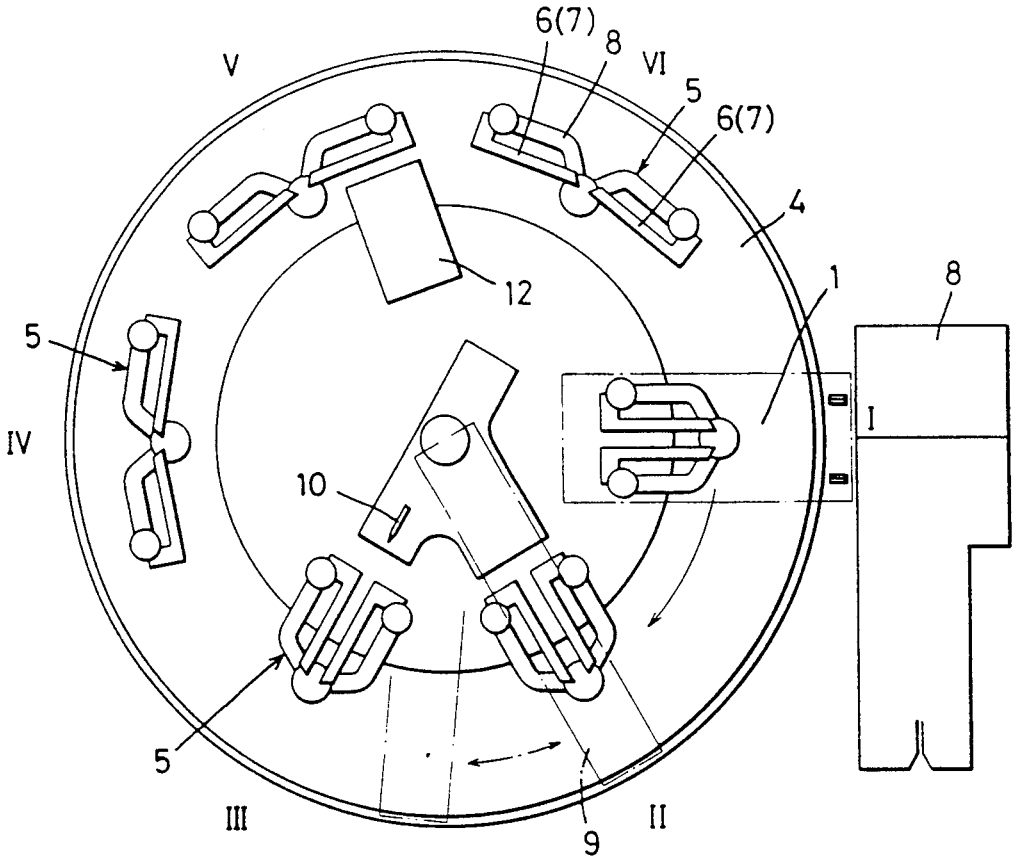
FIG. 14 is a plan view of the panty part sewing machine.
Figure 17:
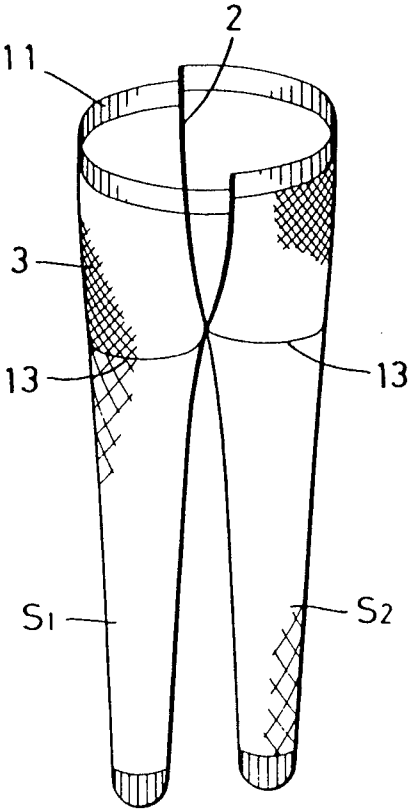
FIG. 17 is a perspective view illustrating defective pantyhose.
Figure 16:
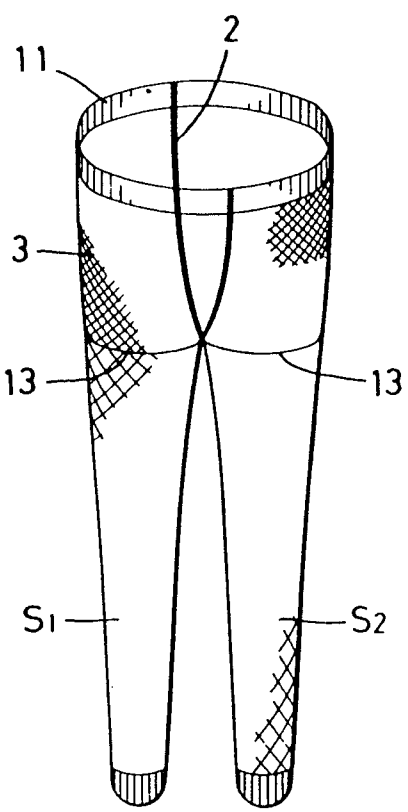
FIG. 16 is a perspective view of the pantyhose.
Figure 15:
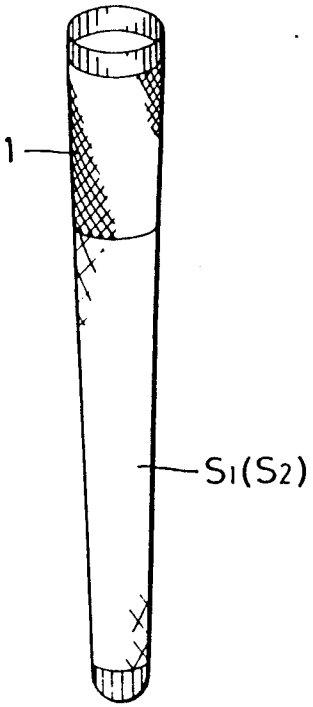
FIG. 15 is a perspective view of the pantyhose material.

Accordingly, as illustrated in FIG. 14, the positioning apparatus 9 according to the present invention is disposed adjacent the second operating station II. Further, since the template unit 5 is intermittently or continuously driven, it is also needed that the positioning apparatus 9 travels at same speed synchronously with the template unit 5 over a prescribed distance in the same direction toward the third operating station III.

For this purpose, the positioning apparatus 9 having at the center thereof a rotary shaft 24 standing in the center of the rotation of the carrier 4 is rotatably supported.

Figure 1:
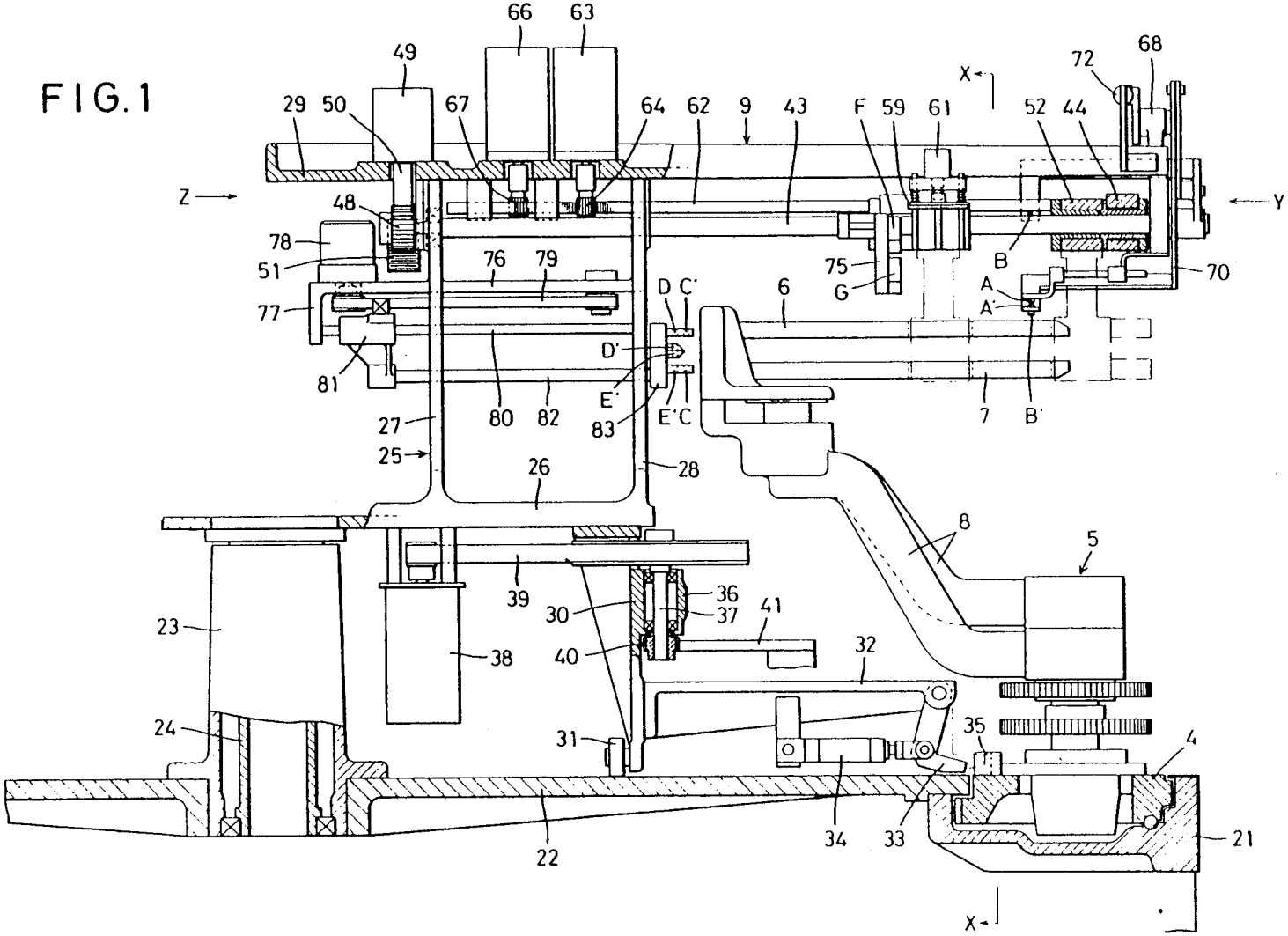
FIG. 1 is a longitudinal front view illustrating the automatic positioning apparatus according to the present invention.
Figure 2:
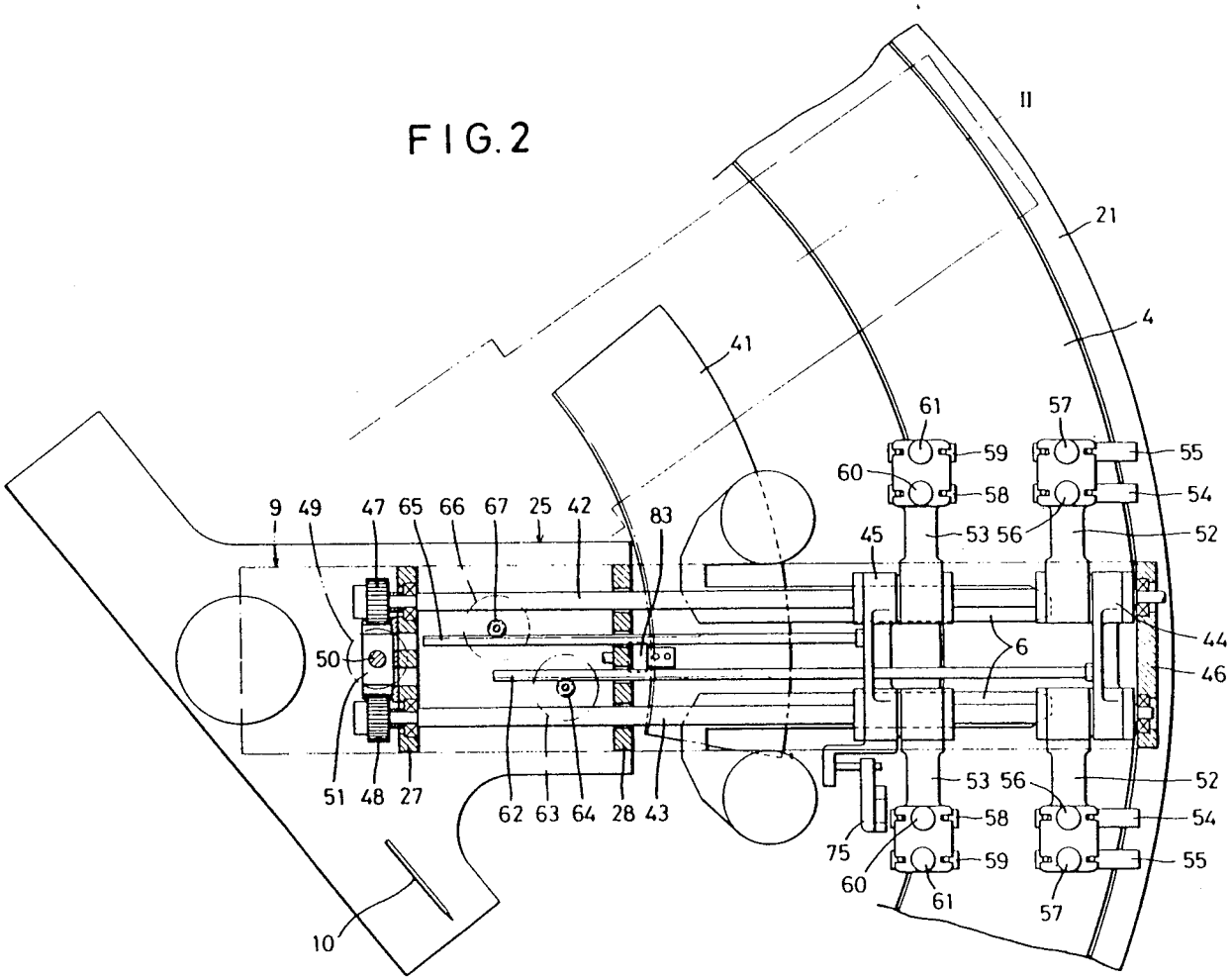
FIG. 2 is a plan view of the automatic positioning apparatus.

FIG. 1 and 2 illustrate the structures and the relation of the template unit 5 and the positioning apparatus 9. The template unit 5 is provided on the carrier 4 slidably supported by a guide rail 21 having a circular track. As mentioned before, pairs of right and left, and upper and lower template assemblies 6, 6, and 7, 7 are provided on the right and left arms, 8, 8 in the template unit 5.

At the center of a base plate 22 extending from an upper surface of the inside of the guide rail 21, a bracket 23 is provided and a unit base 25 is fixed so as to attach main components of the positioning apparatus 9 at the upper end of the rotary shaft 24 rotatably supported by the bracket 23.

The unit base 25 is so formed that a pair of perpendicular walls 27, 28 is opposed to each other at the inside and outside of the rotation track on the upper surface of a lower plate 26 fixed on the rotary shaft 24. At upper ends of both perpendicular walls 27, 28, there is formed an upper plate 29 horizontally protruding toward the guide rail 21.

A receiving roller 31 rolling on the base plate 22 is rotatably supported at the lower end of a downward bracket 30 fixed at an end of the lower surface of the lower plate 26. A horizontal bracket 32 is protruded toward the guide rail 21 at the lower end of the downward bracket 30. An L-shaped follow-up claw 33 rotatably supported at the lower end portion of the horizontal bracket 32 is swung by a cylinder 34.

A follow-up block 35 engaged to and disengaged from the end of the follow-up claw 33 is fixed inside of the template unit 5 on the carrier 4 rotating along the guide rail 21. While the follow-up claw 33 is engaged to the follow-up block 35 by extending the cylinder 34, the unit base 25 is rotated integrally with the rotation of the template unit 25.

At the outside surface of the downward bracket 30, a longitudinal shaft 37 supported by bearings 36 is provided. A servo motor 38 attached to the lower surface of the lower plate 26 and the longitudinal shaft 37 are moved together through a belt 39 and a pulley. A pinion 40 is fixed at the lower end of the longitudinal shaft 37. A rack plate 41 to be engaged with the pinion 40 is fixed on the base plate 22.

As FIG. 2 illustrates, the rack plate 41 is extended from the second operating station II and to a position before the third operation station III and is so formed as to have a shape of an arc of a circular having its center at the shaft core of the unit base 25. The unit base 25 positioned near the third operating station III is caused to return quickly to the position adjacent the second operating station II, as illustrated by two short dashed lines in FIG. 2, by rotating the pinion 40 through the servo motor 38.

Two spline shafts 42 and 43 are disposed along the lower surface of the upper plate 29 in the unit base 25 and first and second spectacle brackets 44, 45 are attached to both spline shafts 42, 43 in such manner as to freely move along the shafts.

Figure 6:
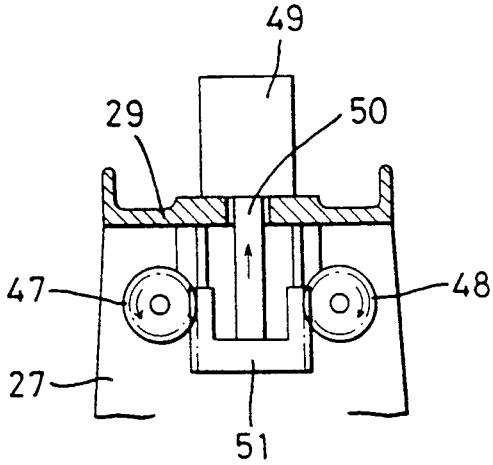
FIG. 6 is a cross sectional view taken from arrow Z of FIG. 1.

Both spline shafts 42, 43 penetrate both perpendicular walls 27, 28 and an end of each spline shaft is supported by the bearings 46 attached at the lower end portion of the upper plate 29 and the other end of each spline shaft is supported by bearings at the inner perpendicular wall 27. Pinions 47, 48 are fixed to the rear ends of both spline shafts 42, 43 protruding rearward from the perpendicular wall 27. As illustrated in FIG. 1 and 6, a rack 51 to be engaged with both pinions 47, 48 is fixed to a piston 50 of a cylinder 49 for up-and-down movement of the positioning plates attached to the upper plate 29. Both spline shafts 42, 43 are rotated in opposite directions through the up- and-down movement of the rack 51 caused by the expansion and contraction of the cylinder 49.

There are attached to the spline shafts 42, 43, a pair of bilateral arm brackets 52, 52 travelling integrally with the first spectacle bracket 44 along the shafts and rotating integrally with the spline shafts 42, 43 and a pair of arm brackets 53, 53 travelling integrally with the second spectacle bracket 45 and rotating integrally with the spline shafts 42, 43.

Plates 54, 54 for positioning garter lines of an upper material and plates 55, 55 for positioning garter lines of a lower material are attached through cylinders 56, 57, respectively, to the ends of the bilateral arm brackets 52, 52 moving integrally with the first spectacle bracket 44. When both arm brackets 52, 52 are rotated downward, the plates 54, 54 for positioning garter lines of the upper material are positioned adjacent both sides of the pair of the upper template assemblies 6, 6 and move toward and away from the pair of templates through the cylinder 56.

Similarly, when both arm brackets 52, 52 are rotated downward, the plates 55, 55 for positioning garter lines of the lower material are positioned adjacent both sides of the pair of the lower template assemblies and moves toward and away from the pair of templates through the cylinder 57.

Figure 3:
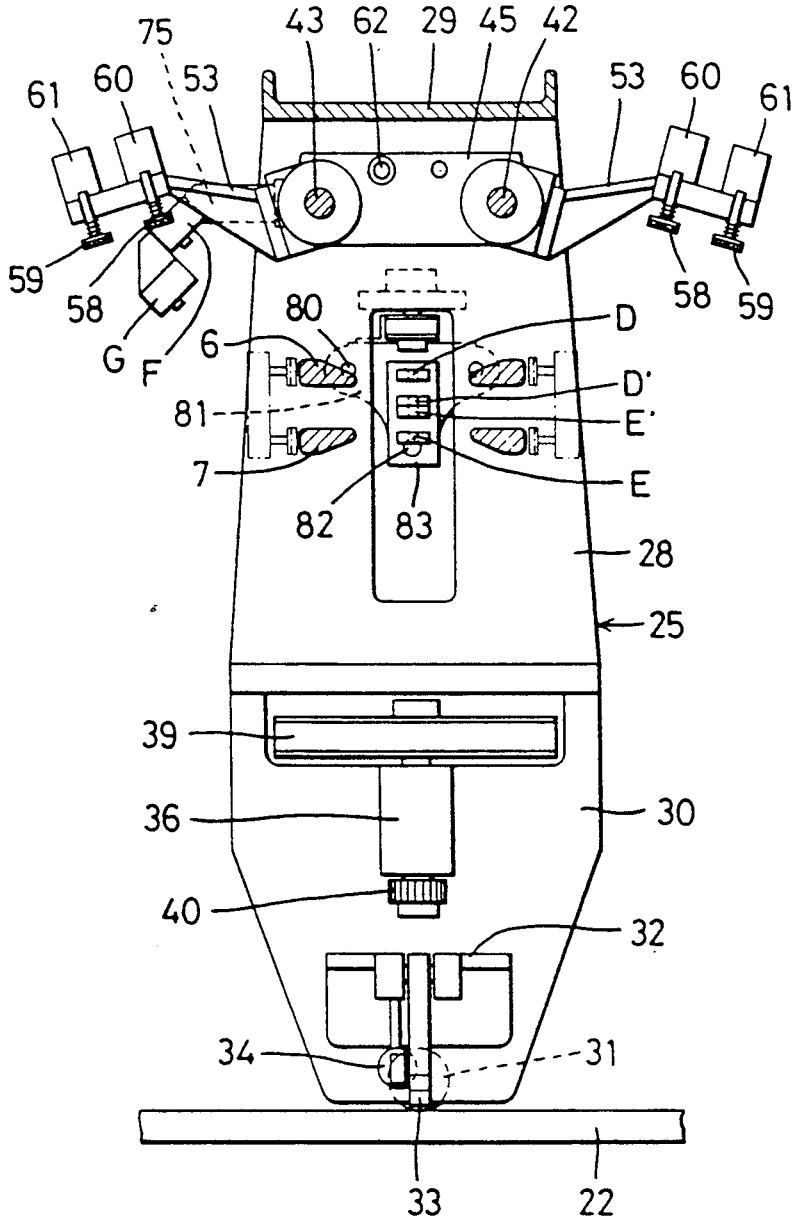
FIG. 3 is a cross sectional view taken along line X—X of FIG. 1.

Further, plates 58, 58 for positioning welt portions of the upper material and plates 59, 59 for positioning welt portions of the lower material are provided through cylinders 60, 61 to the ends of the bilateral arm brackets 53, 53 moving integrally with the second spectacle bracket 45, as illustrated in FIG. 3. When the arm brackets 53, 53 are rotated downward as illustrated by two short dashed lines in FIG. 3, the plates 58, 58 for positioning welt portions of the upper material are positioned adjacent both sides of the pair of the upper template assemblies 6, 6 and the plates 59, 59 for positioning welt portions of the lower material are positioned adjacent both sides of the pair of the lower template assemblies 7, 7. The plates for positioning welt portions of the upper and lower materials moves back and forth through cylinders 60, 61, respectively.

A rack lever 62 connected to the first spectacle bracket 44 penetrates the second spectacle bracket 45 and the outer perpendicular wall 28 so as to be engaged with a pinion 64 of a pulse motor 63 fixed on the upper plate 29. The plates 54, 55 for positioning garter lines move back and forth through the rack lever 62 with forward and reverse rotation of the pulse motor 63.

Furthermore, a rack lever 65 connected to the second spectacle bracket 45 penetrates the outer perpendicular wall 28 so as to be engaged with a pinion 67 of a pulse motor 66 fixed on the upper plate 29. The plates 58, 59 for positioning welt portions move back and forth with forward and reverse rotation of the pulse motor 66.

Figure 4:
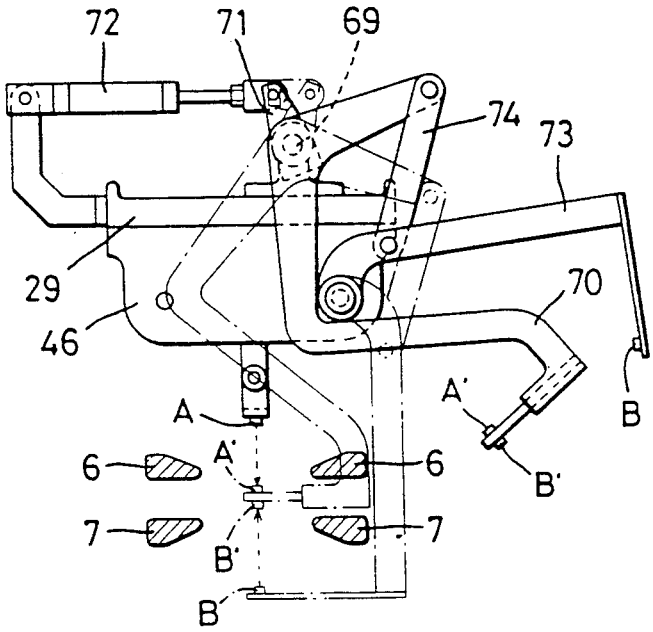
FIG. 4 is a cross sectional view taken from arrow Y of FIG. 1.
Figure 5:
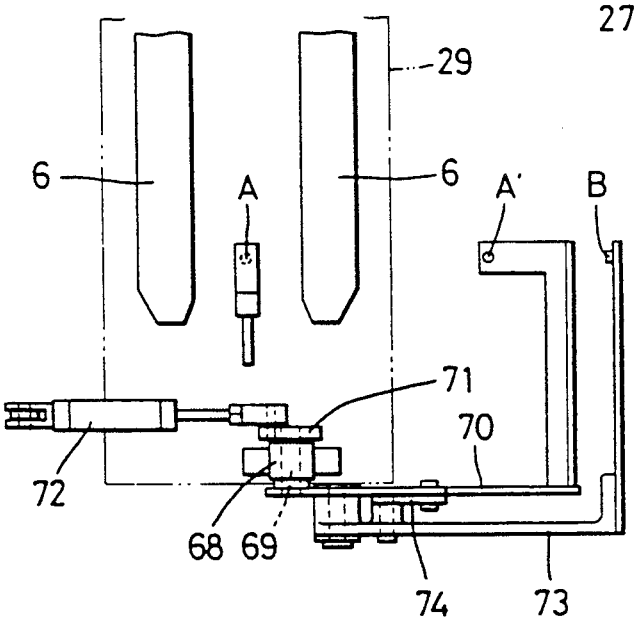
FIG. 5 is a plan view of FIG. 4.
Figure 7A:
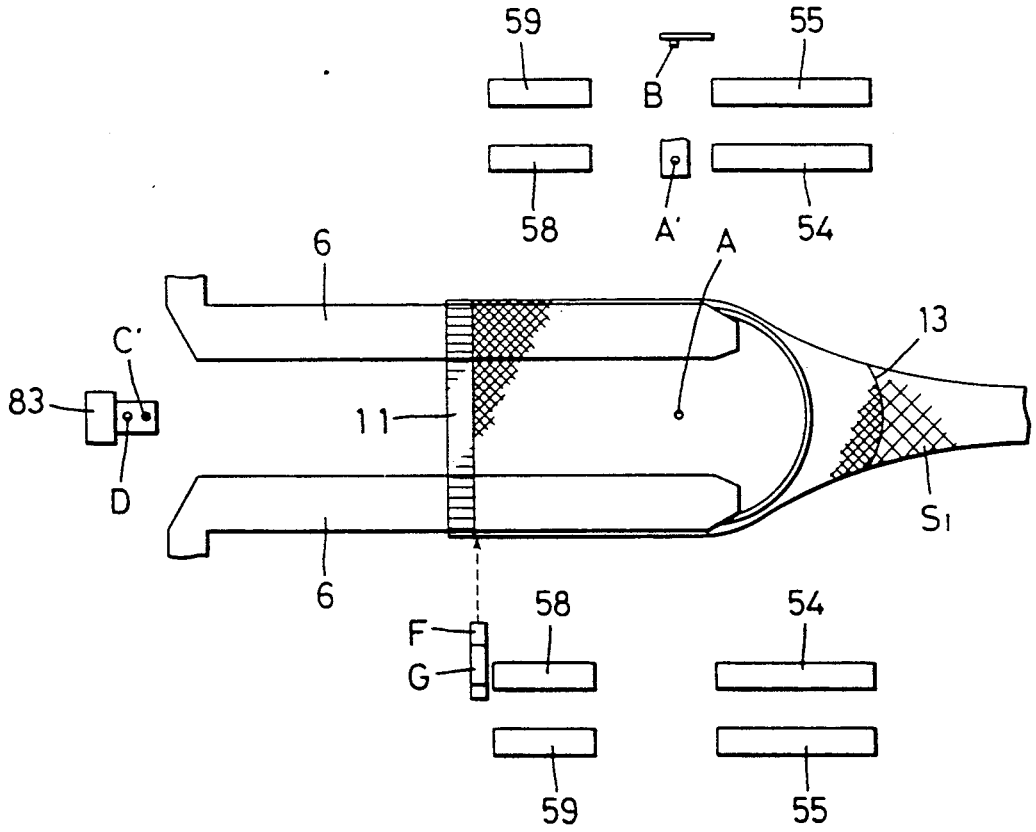
FIGS. 7*a*–7*d*, 8*a*–8*d*, 9, 10*a*–10*b*, and 11*a*–11*b* are explanatory views illustrating the operation order of the automatic positioning apparatus.
Figure 7B:
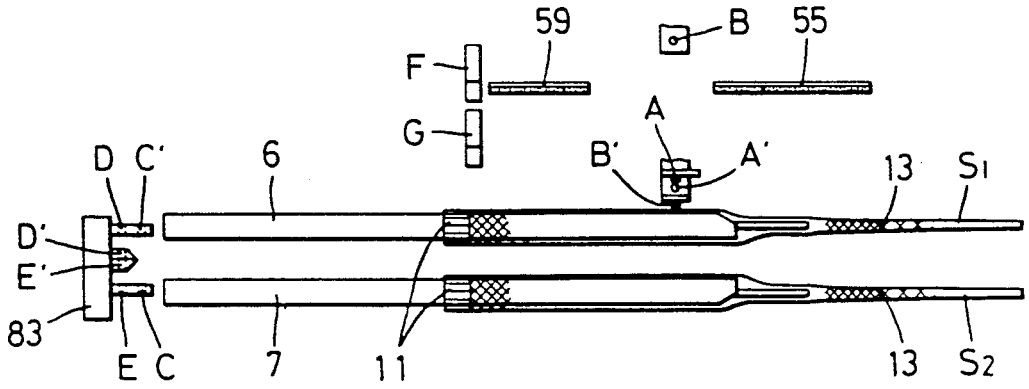
Figure 7C:
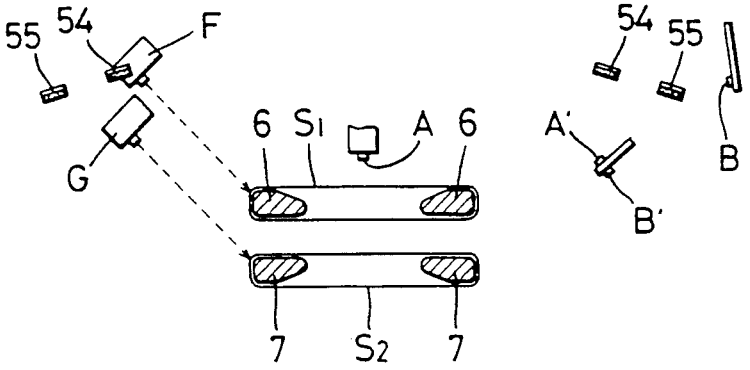
Figure 7D:
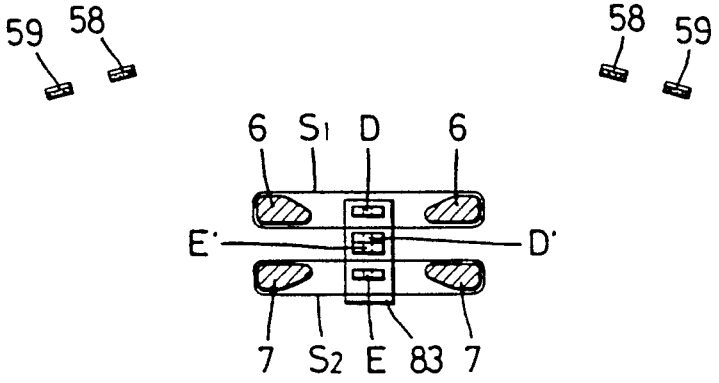

At the end of the upper plate 29, there is provided a shaft 69, as shown is in FIG. 4 and 5, supported by bearings 68. An irregularly-shaped concave arm 70 is attached to an end of the shaft 69. A cylinder 72 is connected to a lever 71 fixed to the other end of the shaft 69. With the expansion and contraction of the cylinder. 72, the arm 70 is swung, having its center at the shaft 69. At the same time, the upper end of an L-shaped arm 73 is rotatably supported by bearings 46 provided on the end of the upper plate 29 and the upper part of the L-shaped arm and the upper end of the arm 70 are connected to each other so as to move them concurrently by a lever 74, thus causing the L-shaped arm 73 to swing in synchronism with the swing of the arm 70.

At the bottom surface of the bearing 46, a sensor A (light projector) for detecting garter lines of the upper material is fixed. The aforementioned arm 70 is rotated from an ascending position as illustrated by the solid line in FIG. 4 to a descending position as illustrated by the dashed lines in FIG. 4. The end of the arm 70 is advanced between the upper and lower materials $S_1$, $S_2$ so that the garter line 13 of the upper material $S_1$, is detected by a sensor A' (light receiver) for detecting a garter line of the upper material, attached to the end of the upper surface of the arm, and the aforesaid light projecting sensor A.

Furthermore, the L-shaped arm 73 descends as shown by the dashed line in FIG. 4 from an ascending position as shown by the solid line in FIG. 4 so that the end thereof is positioned below the lower material $S_2$. Thus, the garter line 13 of the lower material is detected by a sensor B' (light receiver) for detecting a garter line of the lower material, attached to the end of the lower surface of the arm 70 and a sensor B (light projector) for detecting a garter line of the lower material, attached to the end of the L-shaped arm.

A supporting bracket 75 is protruded at one side of the second spectacle bracket 45. As FIG. 3 shows, a sensor F (reflecting type) for detecting the presence of the upper material and sensor G (reflecting type) for detecting the presence of the lower material are attached to the supporting bracket 75, thus making it possible to detect the upper material roughly fitted to the upper template assemblies 6, 6 and the lower material roughly fitted to the lower template assemblies 7, 7.

At intermediate plate 76 is provided between the perpendicular walls 27, 28 and a rear intermediate plate 77 is provided at the outside of the rear perpendicular wall 27. An endless belt 79 is bridged between a pulley attached to the output shaft of a pulse motor 78 provided on the rear intermediate plate 77 and a pulley supported rotatably at the lower surface of the intermediate plate 76. A slide bracket 81 is attached to a horizontal guide shaft 80 so provided as to be positioned below the intermediate plates 76, 77. The upper part of this bracket 81 is fixed to a part of the endless belt 79 so that the slide bracket 81 moves back and forth along the slide shaft 80 by driving the pulse motor 78 forward and reverse.

A horizontal moving shaft 82 of which one end is fixed to the lower part of the slide bracket 81 penetrates both perpendicular walls 27, 28. To the other end of the moving and retreating shaft 82, protruding from the perpendicular wall 28, an E-shaped bracket 83 is fixed.

When at the backward position, the E-shaped bracket 83 is in the standby position behind the upper and lower template assemblies 6, 6, 7, 7, as shown in FIG. 1, and upon moving forward, this bracket is advanced between the template assemblies 6, 6 and 7, 7.

At the front surface of the E-shaped bracket, there are provided a light projecting sensor C and a light receiving sensor C' for detecting welt portions of upper and lower materials, a light projecting sensor D and a light receiving sensor D' for detecting welt portion of the upper material and a light projecting sensor E and a light receiving sensor E' for detecting a welt portion of the lower material.

The automatic positioning apparatus according to the present invention is constructed as explained above, and operation thereof will now be explained with reference to FIG. 7 through 13.

In the initial state, as illustrated by two short dashed lines in FIG. 2, the unit base 25 in the standby condition is positioned adjacent the second operating station II. The follow-up claw 33 is at a backward position as illustrated by the solid line in FIG. 1, the cylinder 34 being contracted. The rack 51 attached to the piston 50 of the cylinder 49 is descended and positioning plates 54, 55, 58 and 59 each is positioned as shown by the solid lines in FIGS. 2 and 3, at an ascending position as shown in FIGS. 7. The pulse motor 66 is stopped and the positioning plates 58,59 for welt portions are at forward positions (original positions) as shown by the solid line in FIG. 1 and 2.

The pulse motor 63 is stopped, with the positioning plates 54, 55 for garter lines being at forward positions (original positions) as shown by the solid lines in FIGS. 1 and 2. The pulse motor 78 is stopped. A group of sensors C, C', D,D', E, E' for detecting welt portions are at backward positions (original positions). The cylinder 72 is contracted. A group of sensors A', B, B' for detecting garter lines stands by at ascending positions as shown by the solid line in FIG. 4. The servo motor 38 is stopped.

Further, pistons of the cylinder 56, 56 and 57, 57 are forwarded. The positioning plates 54, 54 and 55, 55 being now at the forward positions descends to come into contact with the sides of the upper and lower templates.

On the contrary, pistons of the cylinder 60, 60 and 61, 61 move backward. The positioning plates 58, 58 and 59, 59 for welt portions are at backward positions and when each plate is descended, it is alienated from each side of the upper and lower template assemblies. In the first operating station I, the pantyhose material $S_1$ and the pantyhose material $S_2$ are fitted roughly to the upper template assemblies 6, 6 and the lower template assemblies 7, 7, respectively, of the template unit 5 travelling along the circular track of the panty part sewing machine.

At this moment, as shown in FIG. 7, the upper and lower materials $S_1$, $S_2$ are so fitted as to pass over a position which can be detected by the sensors F, G for detecting the presence of the upper and lower materials.

As the template unit 5 travels to the second operating station II, as shown by the two short dashed line in FIG. 1, the piston of the cylinder 34 moves forward and the follow-up claw 33 is engaged with the follow-up block 35 which results in integral and concurrent move of the unit base 25 including the cutter means 10 with the template unit 5, having the rotary shaft 24 as its axis. At this moment, the upper plate 29 of the unit base 25 is positioned right above the template unit 5.

After an appropriate detecting means such as, for example, a proximity switch and the like, have detected the forwarded end of the piston of the aforementioned cylinder 34, the cylinder 72 is first driven and then the cylinder 49 and the pulse motor 78 are concurrently driven.

Figure 8A:
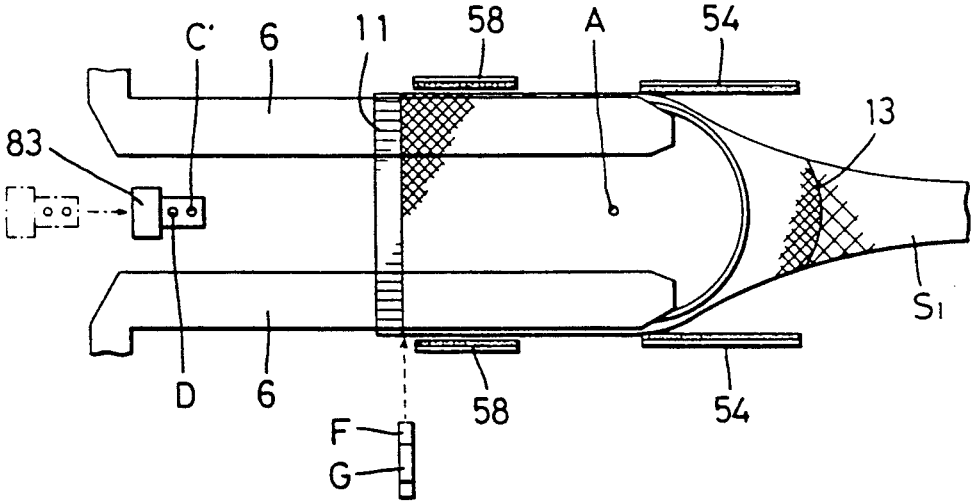
Figure 8B:
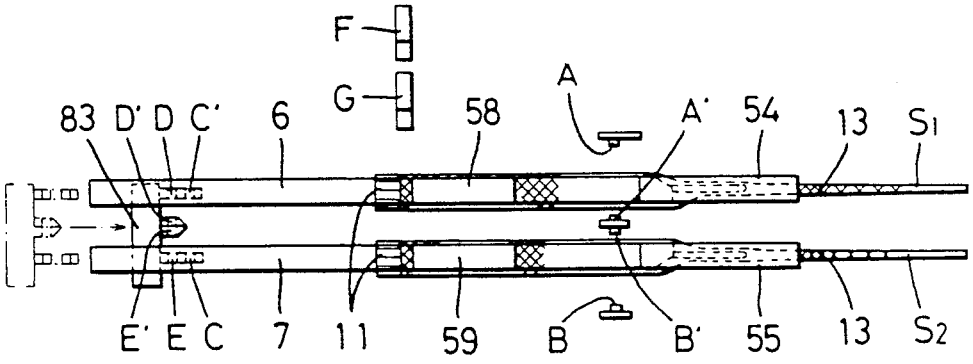
Figure 8C:
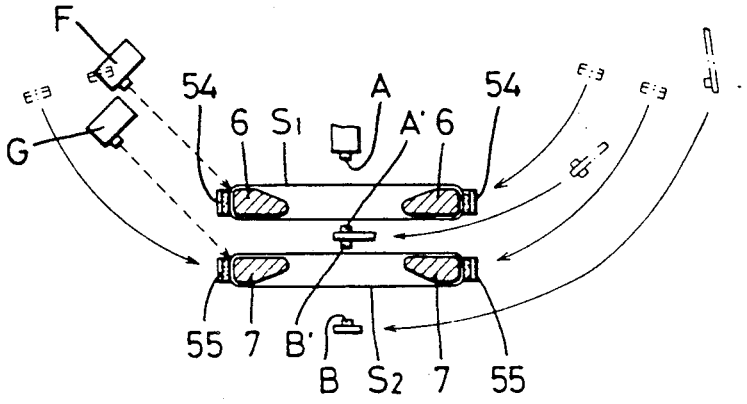

By forward movement of the piston of the cylinder 72, the group of sensors A', B and B' for detecting garter lines are positioned from the ascending standby positions to the descending positions: that is, the sensors A' and B' are disposed in the middle of the upper and lower template assemblies 6, 7, and the sensor B is disposed in the lower middle of the lower template assemblies 7, 7 (See positions shown by the dashed line in FIG. 4 and FIG. 8*c*). Thus the sensors A, A', B, B' are disposed by aligning upper and lower positions in relation to each other.

As to the drive of the cylinder 49, the piston thereof is moved backward so that the rack 51 is elevated to cause the rotation of both spline shafts 42, 43, thus each positioning plate 54, 55, 58, 59 being caused to swing and descend from ascending standby positions to descending positions (perpendicular positions) (See FIG. 1, the positions illustrated by the two short dashed line in FIG. 3 and FIGS. 8.).

At the descending positions of the positioning plates, the positioning plates 54, 55 for garter lines each are brought into contact with the sides of the template assemblies due to the pistons of the cylinders 56, 57, being at the forward positions, which results in that the materials $S_1$, $S_2$ fitted to the upper and lower template assemblies are pressed between the template assemblies and held in nipped sate (See FIGS. 8*a* and 8*c*).

Figure 8D:
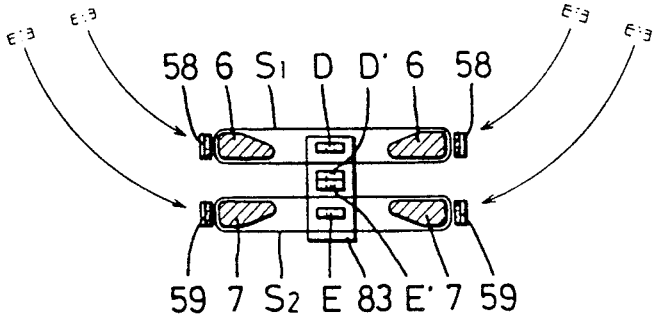

On the other hand, the plates 58, 59 for positioning welt portions are held at a distance from the upper and lower template assemblies, due to the pistons of the cylinders 60, 61 being at the backward positions (See FIGS. 8*a* and 8*d*).

To drive the pulse motor 78 (forward drive), a group of sensors C, C', D, D', E, E' for detecting welt portions, all attached to the E-shaped bracket 83, are moved forward to prescribed positions between the template assemblies (See FIG. 8*a* and 8*b*).

Figure 13:
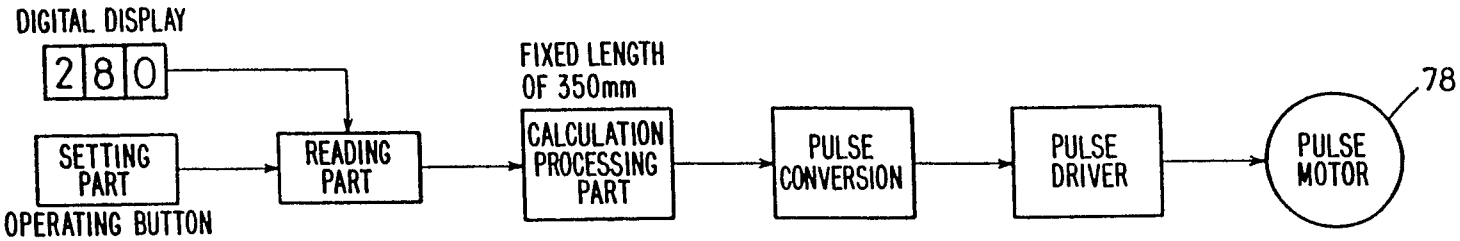
FIG. 13 is a flow chart of control in the material positioning part.

The prescribed length of the forward move of the E-shaped bracket can optionally be selected by a microcomputer control as shown in a flowchart in FIG. 13, and is displayed in digital.

Figure 12:
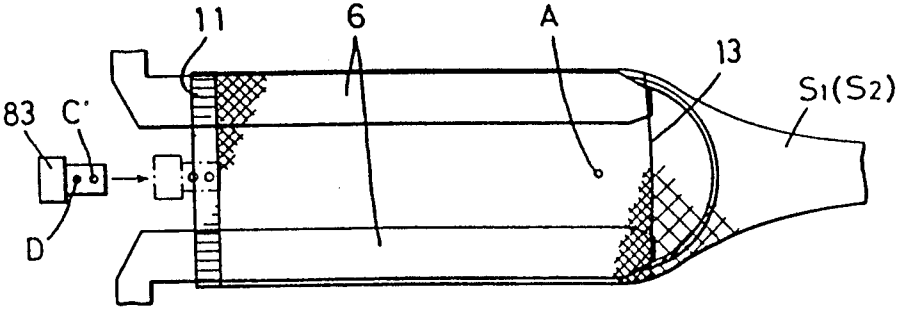
FIG. 12 is an explanatory view illustrating the relation of the template assemblies and the material.

As shown in FIG. 12, in the case that a material is fitted to the template assemblies by, for example, 280 mm in length, an operator sets an operation button of a setting part at 280. Then the numerals 280, via a reading part, is displayed in digital at a display part. At a calculation processing part, a calculation is carried out to obtain a value subtracting the prescribed length of 280 mm from a fixed length of 350 mm, that is, 70 mm. The length of 70 mm is converted into pulse and the pulse is signaled to the pulse motor through a driver that the motor is driven to move the E-shaped bracket 83 forward by length of 70 mm. After the detection of the cylinder 49 and the forwarded end of the E-shaped bracket, the pulse motors 63, 63 are then concurrently driven (forward drive), so that all the plates 58, 58 and 59, 59 for positioning welt portions 11 and garter lines 13, respectively, and the sensors G, E start to synchronously move backward along the template assemblies from the forward positions.

As a result, the upper and lower pantyhose materials $S_1$, $S_2$ having been fitted roughly to the upper and lower template assemblies are now fully fitted to these template assemblies by the plates 54, 55 for positioning garter lines. At this time, even though the plates 58, 59 for positioning welt portions and the sensors F, G are also moving backward, the welt portions 11 are left as they are since the plates 58, 59 are kept away from the template assemblies. Accordingly, the materials $S_1$, $S_2$ fitted to the template assemblies by the plates 54, 55 for positioning garter lines are wrinkled on the template assemblies (See FIG. 9.).

Figure 9:
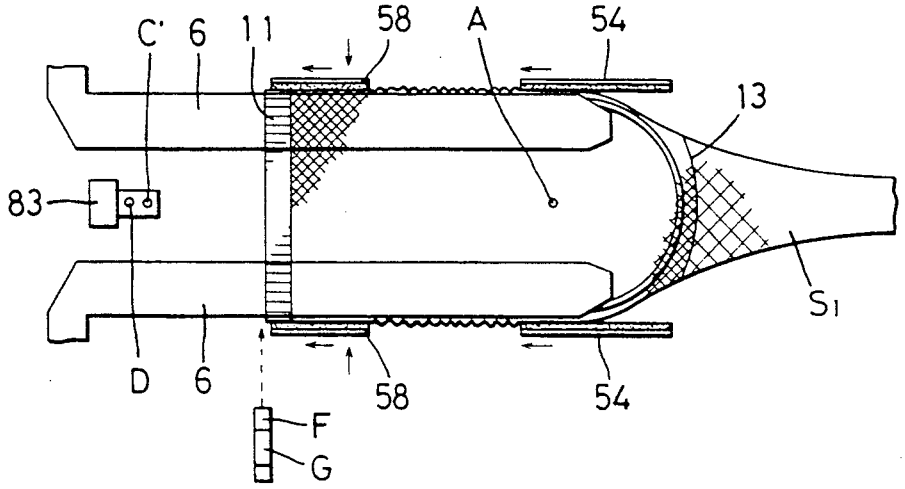

Then when the materials $S_1$, $S_2$ roughly fitted to the template assemblies are not detected by the sensors F, G moving backward, the plates 58, 59 for positioning welt portions are brought into contact with the sides of the template assemblies by the forward move of the pistons of the cylinders 60, 61, thus pressing and nipping the upper and lower materials $S_1$, $S_2$ (See FIG. 9.).

Consequently, the entire portions of the upper and lower materials $S_1$, $S_2$ having been fitted only roughly to the template assemblies are caused to fit deeply onto the template assemblies by further moving both positioning plates 58, 59 and 54, 55 backward.

Since the materials $S_1$, $S_2$ are gathered in a wrinkled state on the template assemblies, upon fitting the welt portions 11 of the materials by the plates 58, 59 for positioning welt portions, the remaining part of the pantyhose materials to be fitted to these template assemblies can be fitted smoothly without being excessively strained.

Thus positioning of the welt portions 11 and the garter lines 13 of the materials $S_1$, $S_2$ fitted to the template assemblies by both positioning plates 54, 55 and 58, 59 is carried out in the course of the fitting operation.

(I) Either preceding one of the upper and lower hems of the welt portions is detected by the sensors C and C' (See FIGS. 10*a* and 10*b*).→The pulse motor 66 is stopped (The plates 58, 59 for positioning welt portions moving backward are stopped. The pressing state is maintained.).

Figure 10A:
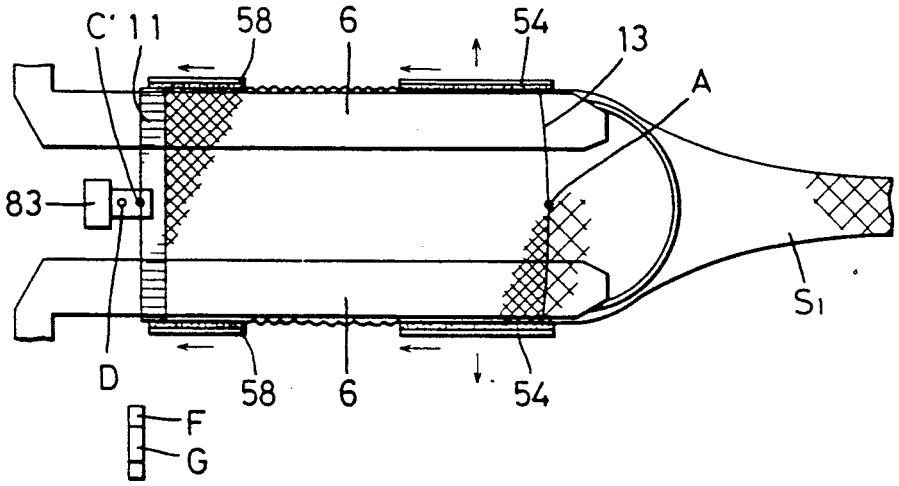
Figure 10B:
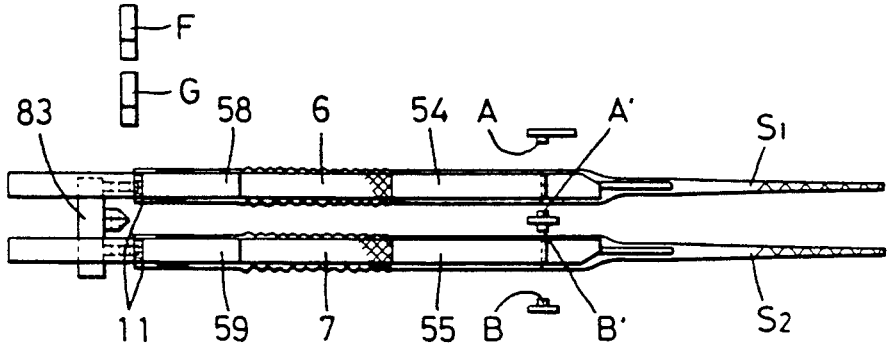
Figure 11A:
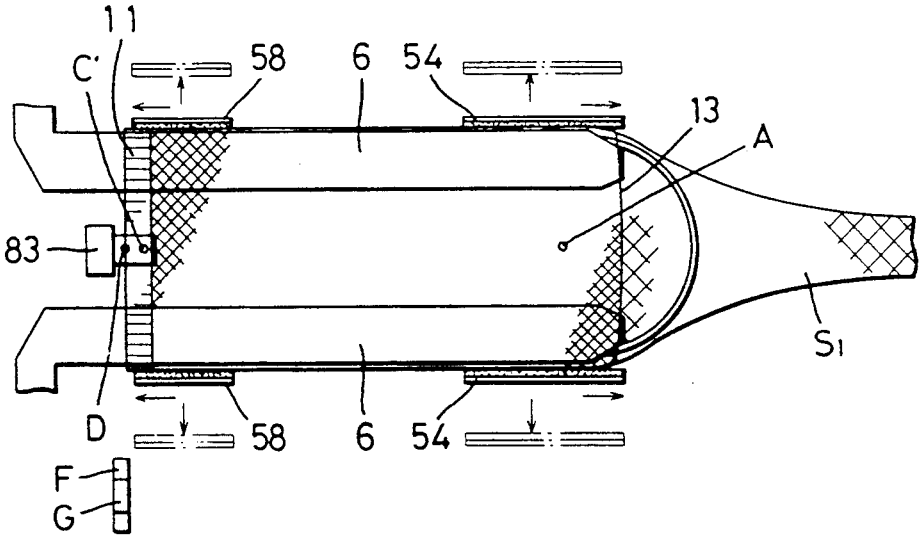
Figure 11B:
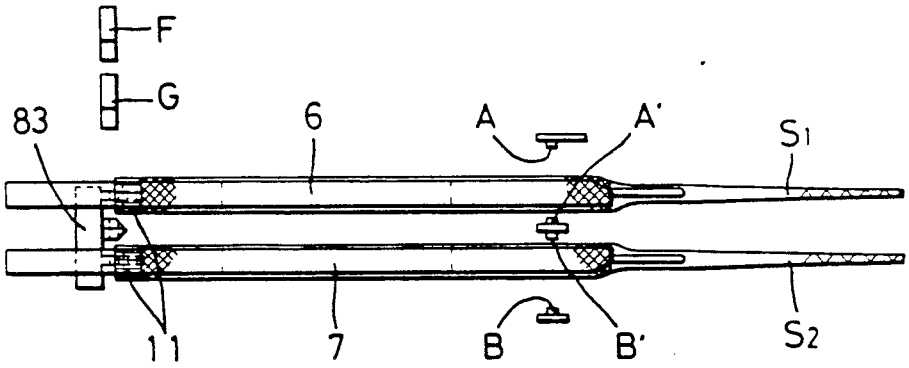

(II) At the same time, the sensors A, A' detect the garter line of the upper material $S_1$ and the cylinders 56, 56 move backward so that the positioning plates 54, 54 release the nip of the material $S_1$ (See FIGS. 10*a* and 10*b*).

The sensors B, B' detect the garter line of the lower material $S_2$ and the cylinders 57, 57 move backward so that the positioning plates 55, 55 release the nip of the material $S_2$.

Under this condition, the pulse motor 63 is stopped (The plates 54, 55 for positioning garter lines stop moving back-ward. . . alienated state) →The upper and lower garter lines 13 are aligned with the sensors A, A', B, B'.

In spite of the travel of the plates 54, 55 for positioning garter lines for the prescribed length (The length to travel is controlled by a proximity switch and the like.), in case that the garter lines 13 are not detected by the sensors A, A', B, B' (This means that the garter lines 13 are not fitted to a prescribed positions.), the following process is taken. The pistons of the cylinders 56, 57 move backward (the plates 54, 55 for positioning garter lines are alienated.).→The pulse motor 63 is stopped and then driven reverse (the plates 54, 55 for positioning garter lines move forward).→The positioning plates 54, 55 are brought back to the original positions.→As the plates 54, 55 have reached the original positions, the pulse motor 63 is stopped.→The pistons of the cylinders 56, 57 move forward.→The pulse motor 63 is driven forward.→The pantyhose material is fitted again by the plates 54, 55 for positioning garter lines.→The sensors A, A', B, B' detect the upper and lower garter lines.→The pulse motor 63 is stopped.

(III) After the condition as described above in (I) and (II), then the cylinders 56, 57 move forward to bring the positioning plates 54, 55 into contact with the template assemblies, and at the same time the pulse motor 66 starts driving forward at low speed (The hem parts of the welt portions are further fitted deeply onto the template assemblies by the plates 58, 59 for positioning the welt portions.).

The sensors D, D' detect the hem of the welt portions of the upper material $S_1$ and the positioning plates 58, 58 are alienated with the backward move of the cylinders 60, 60.

The sensors E, E' detect the hem of the welt portions of the lower material $S_2$ and the positioning plates 59, 59 are alienated with the backward move of the cylinders 61, 61.

Under this condition, the pulse motor 66 is stopped.→The positioning of the hems of the upper and lower welt portions in alignment with each other is completed (Thus the upper and lower materials $S_1$, $S_2$ are fully fitted to the prescribed length on the template assemblies.).

(IV) In synchronism with the low-speed forward drive of the pulse motor 66, the pulse motor 63 is driven reverse at low speed for a period of time prescribed in advance by a timer (not shown).→Due to this, the positioning plates 54, 55 cause the garter lines 13 in alignment with the sensors A, A', B, B' to return to the basic points (end positions) of the template assemblies (See FIG. 11*a*.).→After the period of time prescribed by the timer is over, the pistons of the cylinders 56, 57 move backward (The positioning plates 54, 55 are alienated-.).→About the same time, the pulse motor 63 is stopped.→The positioning of the garter lines in alignment with each other is completed.

In case that the positioning of the garter lines 13 is carried out a the basic points (end portions) of the template assemblies (In this case, the sensors A, A', B, B' are disposed at the basic points.), the materials of the garter lines 13 are not yet fully stretched and accordingly the detection by the sensors cannot be ensured. To ensure the detection by the sensors, therefore, the materials of the garter line portions are fitted once to the template assemblies to stretch said portions.

(V) When the welt portions 11 and the garter line 13 of the upper and lower materials $S_1$, $S_2$have been positioned by aligning with each other on the template assemblies through the operation as explained above, then the cylinder 49, the pulse motor 78, the cylinder 72 and the cylinder 34 are operated reversely in order. The operation of the cylinder 49, by which the piston thereof is moved forward (downward), causes all the positioning plates 54, 55, 58, 59 to the swing and bring back from the descending positions to the elevated positions. The pulse motor 78 is driven reverse so as to return the E-shaped bracket 83 (the group of the sensors C, C', D, D', E, E' for detecting the welt portions) back to the original position. The operation of the cylinder 72 by which the piston thereof is moved backward, causes the group of the sensors A', B, B' for detecting the garter lines to swing and bring back from the descending positions to the elevated standby positions. The engagement of the follow-up claw 33 with the follow-up block 35 is released through the operation of the cylinder 34 in which the piston thereof is moved backward. With detecting this release, the servo motor 38 is driven to rotate and bring back the entire unit base 25 from the position illustrated in FIG. 2 by the solid line to the position illustrated by the dashed line (original position).

Further, in the course of the rotation and return of the unit base 25, the pulse motors 63, 66 are driven (reverse) so as to cause each positioning plate 54, 55, 58, 59 having been swung and returned to the elevated positions to move forward and return to each original position.

Furthermore, in the course of the forward move and return of each positioning plate, the pistons of the cylinders 56, 57 are moved forward to move one pair of positioning plates 54, 55 forward.

With the operation as described above, one cycle of the operation is thus completed and the unit base 25 is brought back to the initial state so as to be ready for the next operation.

As explained above, according to the present invention, only part of the upper and lower pantyhose materials is fitted roughly to the upper and lower template assemblies of the template unit. The following operation to fit the pantyhose materials fully to the template assemblies and to position by aligning the hems of the welt portions and the garter lines of the upper and lower materials in relation to each other is all carried out automatically. As a result, the fitting operation of the upper and lower materials to the template assemblies can be substantially simplified compared to the prior art, which results in increasing efficiency in an automatic panty part sewing machine and considerably reducing the work of operators in the workshop.

Additionally, the positioning of the hem portions of the welt portions and the garter lines of the upper and lower materials by aligning in relation to each other is so carried out that each group of the sensors for detecting the welt portions and the garter lines detect the upper and lower materials independently and, in accordance with the detection, each positioning plate is operated independently, which results in accurate positioning of the hem portions of the welt portions and the garter lines by aligning in relation to each other. Consequently, accurate sewing in the following sewing process of the panty part by an automatic panty part sewing machine is ensured, thus making it possible to obtain superior pantyhose.

Further, in inserting the pantyhose materials into the template assemblies, the materials of the garter line portions which have not been fitted are first inserted and slacked on the template assemblies and then the welt portions are inserted deeply into the template assemblies so that positioning of the welt portions and the garter lines is carried out, which enables the materials to be smoothly inserted without excessively strain upon the positioning process.

What is claimed is:

1. An apparatus for automatically positioning pantyhose materials in a panty part sewing machine in which a template unit comprising a pair of upper and lower template assemblies is so disposed as to travel along a circular track and a panty part of pantyhose materials fitted to each of said upper and lower template assemblies is sewn into seams, characterized in:

a unit base which is located behind positions for fitting pantyhose materials by the template assemblies and above the template unit and which synchronously travels over a certain range with the template unit at equal speed, comprising:

positioning plates of upper and lower template assemblies for welt portions, each of which freely moves toward and away from each side of the upper and lower template assemblies and along the length of the template assemblies to make welt portions held from both sides move deeply onto the template assemblies;

positioning plates of upper and lower template assemblies for garter lines, each of which freely moves toward and away from each side of the upper and lower template assemblies along the length of the template assemblies to make a panty part held from both sides move deeply onto the template assemblies prior to the move of the positioning plates for welt portions;

detection sensors for detecting pantyhose materials roughly fitted to each upper and lower template assembly and actuating the positioning plates for garter lines and welt portions in a delayed manner;

sensors for positioning garter lines, which detect garter lines of the materials having been fitted by the plates for positioning garter lines at locations above and below each pantyhose material fitted to the upper and lower template assemblies to make the plates for positioning garter lines stop; and sensors for positioning welt portions, which detect welt portions having been moved by the plates for positioning welt portions at front positions to make the plates for positioning welt portions stop.

* * * * *